US009016929B2

(12) United States Patent
Tasch et al.

(10) Patent No.: US 9,016,929 B2
(45) Date of Patent: Apr. 28, 2015

(54) APPARATUS FOR MIXING AND CONTROLLING THE TEMPERATURE OF LABORATORY VESSEL CONTENTS

(75) Inventors: Henner Tasch, Hamburg (DE); Ute Mahlstedt, Norderstedt (DE); Arne Schafrinski, Bad Oldesloe (DE); Manuel Mayer, Bad Oldesloe (DE); Rüdiger Huhn, Luebeck (DE)

(73) Assignee: Eppendorf AG, Hamburg (DE)

( * ) Notice: Subject to any disclaimer, the term of this patent is extended or adjusted under 35 U.S.C. 154(b) by 157 days.

(21) Appl. No.: 13/643,914

(22) PCT Filed: May 3, 2011

(86) PCT No.: PCT/EP2011/002189
§ 371 (c)(1),
(2), (4) Date: Jun. 19, 2013

(87) PCT Pub. No.: WO2011/141132
PCT Pub. Date: Nov. 17, 2011

(65) Prior Publication Data

US 2013/0265845 A1 Oct. 10, 2013

(30) Foreign Application Priority Data

May 3, 2010 (DE) ..... 10 2010 019 231

(51) Int. Cl.
*B01F 11/00* (2006.01)
*B01F 15/06* (2006.01)
(Continued)

(52) U.S. Cl.
CPC ..... *B01F 15/065* (2013.01); *B01F 11/0014* (2013.01); *B01L 7/52* (2013.01); *B01L 9/523* (2013.01); *B01L 2300/1805* (2013.01); *B01F 9/003* (2013.01)

(58) Field of Classification Search
USPC ..... 366/144–146, 108–128, 208–219; 435/286.7, 303.3
See application file for complete search history.

(56) References Cited

U.S. PATENT DOCUMENTS 3,944,188 A 3/1976 Parker et al.
6,416,719 B1 7/2002 Fawcett et al.
(Continued)

FOREIGN PATENT DOCUMENTS

DE 10 2004 021 664 12/2005
DE 10 2005 035 355 2/2007
(Continued)

OTHER PUBLICATIONS

International Search Report for PCT/EP2011/002189, mailed Aug. 19, 2011.
(Continued)

*Primary Examiner* — Charles Cooley
(74) *Attorney, Agent, or Firm* — White & Case LLP

(57) ABSTRACT

The present invention relates to an apparatus for mixing and controlling the temperature of laboratory vessel contents with an accommodating device in detachable connection with an exchangeable block for accommodating and controlling the temperature of laboratory vessels and with a drive by which the accommodating device can be set in a mixing motion, and with a temperature control device with a heat source or sink in heat-conducting connection with the exchangeable block at least through in each case at least one adjoining contact face firstly on the accommodating device and secondly on the exchangeable block, which is characterized in that the detachable connection is maintained by a spring element which, by virtue of its spring force, horizontally clamps together a first undercut between the accommodating device and the exchangeable block in at least one first direction.

12 Claims, 4 Drawing Sheets

(51) Int. Cl.

| | |
|---|---|
| ***B01L 7/00*** | (2006.01) |
| ***B01F 9/00*** | (2006.01) |
| *B01L 9/00* | (2006.01) |

(56) References Cited

U.S. PATENT DOCUMENTS

| | | | | |
|---|---|---|---|---|
| 6,514,465 | B2 | 2/2003 | Steiner | |
| 8,016,478 | B2 * | 9/2011 | Ebers et al. | 366/208 |
| 8,550,696 | B2 * | 10/2013 | Ebers et al. | 366/209 |
| 2003/0008383 | A1 | 1/2003 | Bordenkircher et al. | |
| 2006/0228268 | A1 | 10/2006 | Heimberg et al. | |
| 2007/0211566 | A1 * | 9/2007 | Ebers et al. | 366/208 |
| 2007/0212265 | A1 * | 9/2007 | Ebers et al. | 422/99 |
| 2008/0206846 | A1 * | 8/2008 | Tasch et al. | 435/286.2 |
| 2010/0124766 | A1 | 5/2010 | Ng et al. | |
| 2010/0143197 | A1 | 6/2010 | Link et al. | |
| 2010/0284238 | A1 * | 11/2010 | Ebers et al. | 366/110 |
| 2013/0045473 | A1 * | 2/2013 | Duerr et al. | 435/3 |
| 2013/0265845 | A1 * | 10/2013 | Tasch et al. | 366/145 |

FOREIGN PATENT DOCUMENTS

| | | |
|---|---|---|
| DE | 10 2006 062 714 | 10/2007 |
| DE | 20 2009 015 600 | 6/2010 |
| WO | WO-98-43740 | 10/1998 |
| WO | WO-2008-135565 | 11/2008 |
| WO | 2010/123205 A2 * | 10/2010 |

OTHER PUBLICATIONS

Written Opinion for PCT/EP2011/002189, mailed Aug. 19, 2011.
International Preliminary Report on Patentability for PCT/EP2011/002189, issued Nov. 8, 2012.

* cited by examiner

APPARATUS FOR MIXING AND CONTROLLING THE TEMPERATURE OF LABORATORY VESSEL CONTENTS

The present invention relates to an apparatus for mixing and controlling the temperature of laboratory vessel contents with an accommodating device in detachable connection with an exchangeable block for accommodating and controlling the temperature of laboratory vessels and with a drive by which the accommodating device can be set in a mixing motion, and with a temperature control device for controlling the temperature of the exchangeable block.

BACKGROUND OF THE INVENTION

Mixing devices in which vessel contents are admixed are sufficiently well known. In particular for laboratories, there are mixers which can also mix small quantities of liquids by small containers also being put together in suitable holders, so-called "exchangeable blocks" (devices for holding vessels which can also be used for controlling the temperature), in very large groups, being of a two, three or even four-figure number. Such vessels and the associated holders can be standardised in the exchangeable blocks. Thus, there are, for example, vessels with 0.2 ml, 0.5 ml, 1.5 ml and 2.0 mm content—as well as respective exchangeable blocks with suitable holders standardised for that purpose. Further, there are, for example, exchangeable blocks for Cryo vessels, for Falcon tubes (e.g. 1.5 ml and 50 ml), for glass vials and beakers, for containers, for microtitre plates with, for example, 96 and 384 vessels (MTP), for deep well plates (DWP), for slides and for PCR plates with 96 vessels (wells). This list is not inclusive; it does, however, indicate what a large variety of laboratory vessels exist, for which the mixers should be suitable.

Because these exchangeable blocks are mostly constructed in such a way that the single vessels are inserted into them from above, a circular translational oscillating mixing motion has become established, by way of preference, for the well-known mixers, which largely proceeds on a horizontal plane. For this purpose, with the well-known mixers an imbalance drive, which is preferably driven by an electric motor, is usually responsible for putting a "table" (an accomodating device, onto which an exchangeable block is fixed) into this circular motion. Usually such mixers are driven with a rotational frequency of 200 rpm to 3,000 rpm, however rotational frequencies of 100 rpm to 10,000 rpm are also possible. The frequency can usually be adjusted.

If the mixing device now also has a temperature control device, so that the laboratory vessel contents cannot only be mixed, but also have the temperature controlled, there is an accommodating device in the case of which a source of heat or sink on the temperature control device heats at least one contact surface on the top, and this contact surface has a thermally conductive link to the exchangeable block mounted on it, and in fact by being located directly on its underside.

As a rule, the contact surface of the accommodating device and the underside of the exchangeable block, which comes into contact with the contact side, are shaped flat, or virtually flat. In that respect, the gradient of the surface usually deviates from the horizontal plane by a maximum of 10°. The contact surface of the accommodating device can make up the complete surface of the accommodating device, but also only a certain proportion of it, usually at least 70%.

In addition, multiple exchangeable blocks can also be attached to an accommodating device, for example 2, 4, 6, 8 or 9. In that regard, the exchangeable blocks preferably have an underside of the same size. In order to produce the thermally conductive contact with the temperature-regulated contact surface of the accommodating device, such exchangeable blocks which usually consist of materials with good thermal conductivity, such as metals, in particular aluminium or silver, wherein the block can be of a solid construction or may have an eroded structure, which, for the purposes of weight reduction, only still has structures for accommodating the sample and good heat transmission from the underside of the exchangeable block to the vessels, are known to be firmly attached to the accommodating device. The screws can be loosened relatively easily with the aid of a tool, such as a screwdriver, so that the exchangeable block can be exchanged, for example, for an exchangeable block for laboratory vessels of a different size.

BRIEF SUMMARY OF THE INVENTION

The object forming the basis for the present invention is to create a mixing device for mixing and heating contents of vessels that are arranged in an exchangeable block, the handling of which is improved. In particular, it should be possible for the user to attach the exchangeable blocks to the mixing device just using the hand, and also detach them again in the same way.

DETAILED DESCRIPTION OF THE INVENTION

Figure 1:
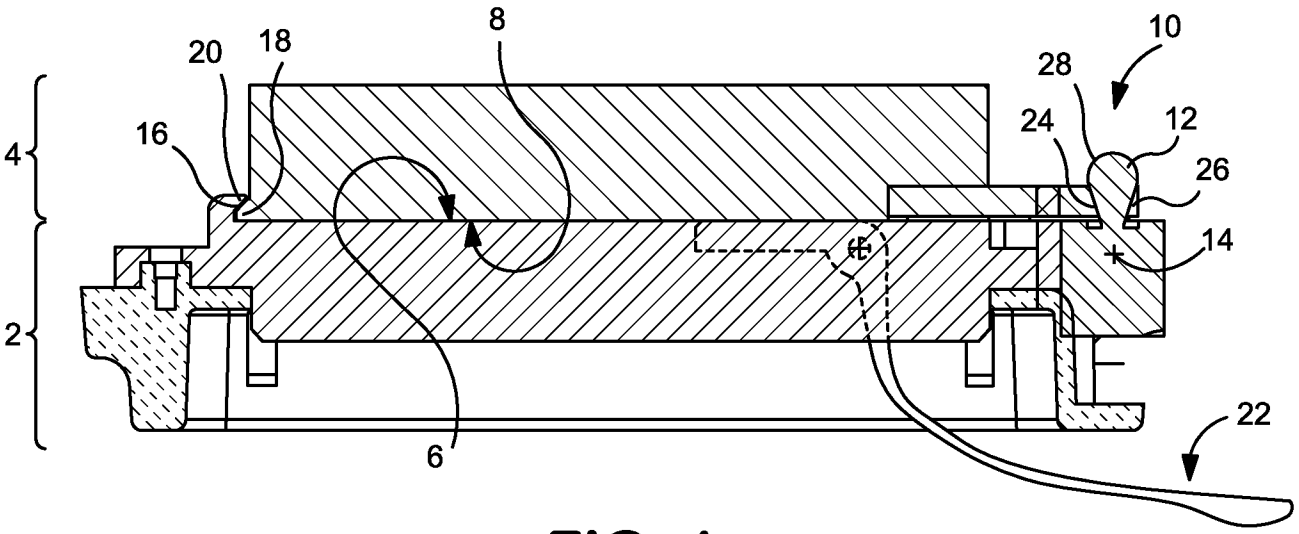
FIG. 1 shows a cropped lateral view through an accommodating device detachably connected to an exchangeable block as a section from a mixing device according to the invention.

The mixing device for mixing and controlling the temperature of laboratory vessel contents, according to the invention has an accommodating device with an exchangeable block, a mixing motion drive and a temperature control device. The accommodating device is loosely connected to the exchangeable block, which is set up for accommodating and controlling the temperature of laboratory vessels. The drive is set up to set the accommodating device together with the exchangeable block in a mixing motion. The temperature control device has a source of heat or sink which has a thermally conductive connection to the exchangeable block through contact surfaces, firstly on the accommodating device and, secondly, on the exchangeable block. The contact surfaces are adjacent to one another.

The contact surface of the accommodating device and the exchangeable block are preferably shaped flat, or virtually flat. In that respect, the gradient of the surface deviates from the horizontal plane by a maximum of 10°, preferably by 3° at the most, and particularly preferably by 1° at the most. The contact surface of the accommodating device can make up the complete surface of the accommodating device, but also only a certain proportion of it, >70%, preferably >80% or, particularly preferably, >90%. In addition, multiple exchangeable blocks can also be attached to an accommodating device, preferably 2, 4, 6, 8 or 9. In that regard, the exchangeable blocks preferably have an underside of the same size.

According to the invention, the detachable connection of the accommodating device to the exchangeable block is held by a spring element, which, through its spring tension, tightens a first undercut into one another horizontally in at least one direction. In this respect, the undercut exists between the accommodating device and the exchangeable block. The undercut is preferably located on the side of the exchangeable block which is opposite the side where the spring element grips. The invention advantageously enables a secure, form-fit connection between the exchangeable block and the accommodating device, even if the latter is exposed to the stresses of the previously mentioned mixing motions. The connection can, firstly, be produced and detached again in a way that is easily manageable, and, secondly, is free of clearance due to the spring pre-load. In particular, the exchangeable block can be connected and detached by the user, just using the hand.

The spring tension applied by the used spring element usually amounts to 30 to 150 N, preferably 50 to 100 N, and, by way of especial preference, 65 to 85 N. As a result, firstly a secure connection between the accommodating device and the exchangeable block is ensured, and, secondly, the tension is only so great that it can also be applied by a user.

To fasten the exchangeable block to the accommodating device securely, it needs to be fixed in both horizontal dimensions (the X and Y directions) and also in the vertical direction (the Z direction). The connection according to the invention ensures a form-fit connection in the Z direction, at least through the first undercut. In at least one first direction (for example X or Y), through its spring tension the spring element tightens the one of the two mould parts undercutting one another into the other, and in this way establishes the connection in this horizontal direction. In this respect, the one mould part is located on the accommodating device, and the other mould part, belonging to it, on the exchangeable block. Preferably, the undercutting mould part undercutting the other one is placed underneath the exchangeable block. The spring tension of the spring element likewise preferably grips underneath the exchangeable block.

By preferably clamping together the two mould parts undercutting one another, also of a second undercut in a second horizontal direction (which is linearly independent of the first horizontal direction), the connection is set against any horizontal movement completely, and in fact, advantageously, free of play. The clamping together also in the second horizontal direction can either be effected through the spring tension of a second spring element or also through the spring tension of the first spring element. In the latter case, the spring element may be designed in such a way that its spring tension has such an impact upon the mould parts that it is broken down, vectorially, into one component acting in the first horizontal direction and one component acting in the second horizontal direction.

Preferably, for one horizontal direction or for both directions in which the spring tensions work horizontally, two spring tensions are provided, so that the forces clamping the exchangeable block are distributed over these spring elements. This makes it considerably easier for the user to operate and detach the spring elements. Accordingly, still further spring elements can also naturally be provided, for one or both horizontal directions. Too great a number of spring elements that need to be operated do, however, in turn, make it troublesome to attach and detach the exchangeable block.

It may also be advantageous not to provide for an undercut in the second horizontal direction, but rather a horizontal stopper, such as a centering pin. Then the connection from the first undercut and said at least one spring element, that works in a horizontal direction, can be made by a bent hook into the undercut, and subsequently folding down the block.

Further advantages and features of the device according to the invention are described with reference to the attached figures, which represent the embodiments of the mixing device in accordance with the invention.

In FIG. 1, an accommodating device 2, which can be put into a horizontal mixing motion by a drive, not shown, is illustrated. Further, the mixing device (not completely shown in its entirety) has a temperature control device (only partially shown) with a heat source (not shown), which can heat the accommodating device 2. The accommodating device has a thermally conductive connection with an exchangeable block 4, which is mounted on the accommodating device 2. The thermally conductive connection is made through largely horizontal contact surfaces 6, 8 lying on top of one another, and in fact, firstly 6, on the top of the accommodating device 2, and, secondly, 8, on the underside of the exchangeable block 4.

The accommodating device and the exchangeable block are detachably connected with one another through a spring element 10, namely a lateral pressure component 10. Lateral pressure components are known construction elements, which have a head 12, which can be moved laterally, on a spring, around a pivotal point 14, in any desired direction. Through its spring tension, the lateral pressure component 10 tautens a first undercut 16—namely an inclined plane 16, as a form-fit active surface of the one 18 of the mould parts 18, 20 undercutting into one another on the exchangeable block 4—into the other 20 of the mould parts undercutting one another, in a first horizontal direction (in the figure towards the left), namely an inclined plane 16, as a form-fit active surface on the accommodating device 2.

The inclined planes 16 on the two mould parts 18 and 20 are orientated in such a way that the tensioning in of the exchangeable block by means of the lateral pressure component 10, 12 (in the figure towards the left) transforms the pre-stress force working towards the left on the inclined plane 16 of the form-fit active surface of the mould part 20 of the accommodating device 18 into a reaction force, which has a vertical force. This vertical force has the effect of a clamping force on the horizontally adjacent contact surfaces 6, 8, and thus advantageously brings about a secure thermally conductive connection between the contact surfaces 6, 8.

Not separately illustrated is a vertical section through the accommodating device and the exchangeable block (in top view) to the section in the figure. The fixing in this second horizontal device is simply formed by lateral vertical delimitation cheeks formed on the accommodating device, between which the exchangeable block is guided in a form-fit manner.

In a vertical direction (the Z direction), the detachable connection is, on the one hand, secured by the undercut 16 described and, on the other hand, by the lateral pressure component.

To release the detachable connection between the exchangeable block and the accommodating device, the contact surfaces 6, 8 lying horizontally adjacent to one another can be pressed apart from one another using a lever device 22. As a result the head 12 of the lateral pressure component 10 is pressed to the side along initial conductive surfaces 24 on the exchangeable block 4 (in the figure towards the right) and finally snaps out from the furcation 26 in the exchangeable block, into which, when the connection was closed (horizontally adjacent contact surfaces 6, 8), it had been inserted.

Alternatively, the connection between the exchangeable block and the accommodating device could be released by a lever (not shown) directly gripping the head 12 of the lateral pressure component 10, and its pivoting in such a way (in the figure towards the right) that the clamping together of the mould parts 16, 18 is released.

A further alternative (likewise not shown) for detaching the connection can be formed by the accommodating device mould part 20 being able to be moved laterally (in the figure towards the left) out of the undercut 20 using a suitable lever (not shown).

The detachable connection illustrated can be detached and, once detached easily produced again by the exchangeable block 4 with its undercut mould part 10 (as well as any second undercut mould part not illustrated, already mentioned above) being inserted into the complementary undercut mould part 20 of the accommodating device 2, wherein which the lateral pressure component 12 (as well as any second lateral pressure component mentioned above) rests on the edges of the respectively associated furcation 26 in the exchangeable block allocated. Second conductive surfaces 28 on the heads 12 of the lateral pressure components are orientated in such a way that they allow the detachable connection from this previous position (not shown) to be snapped into place by pressing vertically on the contact surfaces that are horizontally adjacent to one another, by the heads 12 of the lateral pressure components 10 then sliding through the furcation 26 and snapping into place.

Figure 2:
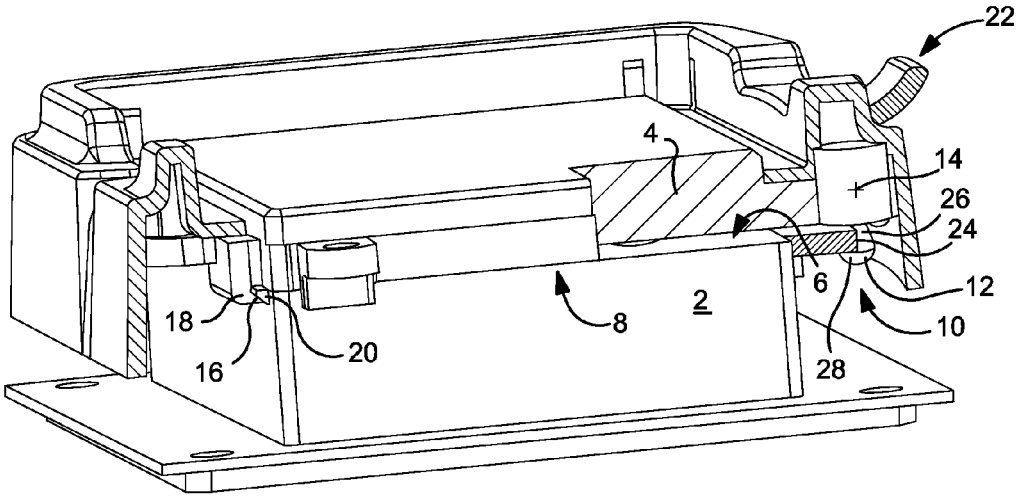
FIG. 2 shows a partially cropped spatial view of an alternative accommodating device according to the invention, detachably connected to an exchangeable block.
Figure 3:
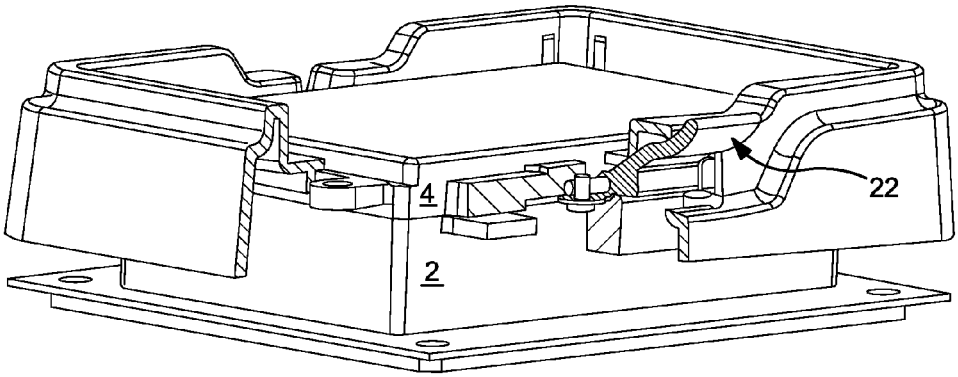
FIG. 3 shows a partially cropped spatial view of the configuration from FIG. 2 from a different perspective.

In FIGS. 2 and 3, a device is shown in a spatial view (partially cut off) which is very similar to FIG. 1 (functionally comparable elements have the same reference numbers as in FIG. 1): also in FIGS. 2 and 3, the detachable connection between the exchangeable block 4 and the accommodating device 2 is formed by a lateral pressure component 10 as a spring element, which, with its lateral (horizontal) spring tension, locks the components of a first undercut in the form of an inclined plane 16 into one another, In contrast to FIG. 1, the lateral pressure component 10 in FIGS. 2 and 3 is, however, attached to the exchangeable block 4 and the furcation 26 (as an active surface complementary to the head 12 of the lateral pressure component 10) on the accommodating device 2 (and not vice versa, as in FIG. 1). The remainder of the description of FIG. 1 can also be read identically to that of FIGS. 2 and 3.

Figure 4:
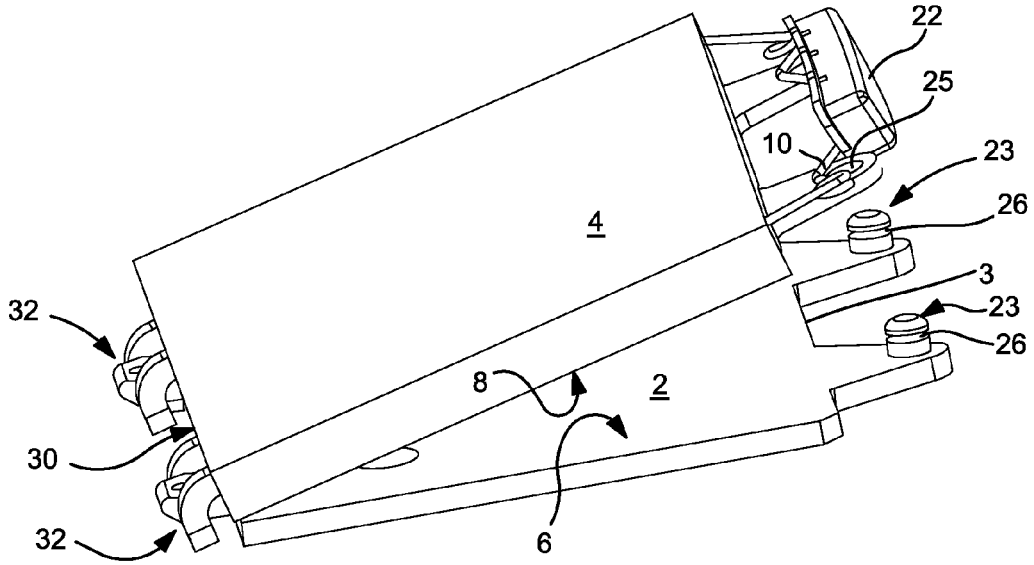
FIG. 4 shows a spatial view of another alternative embodiment of an accommodating device detachably connected to an exchangeable block.
Figure 5:
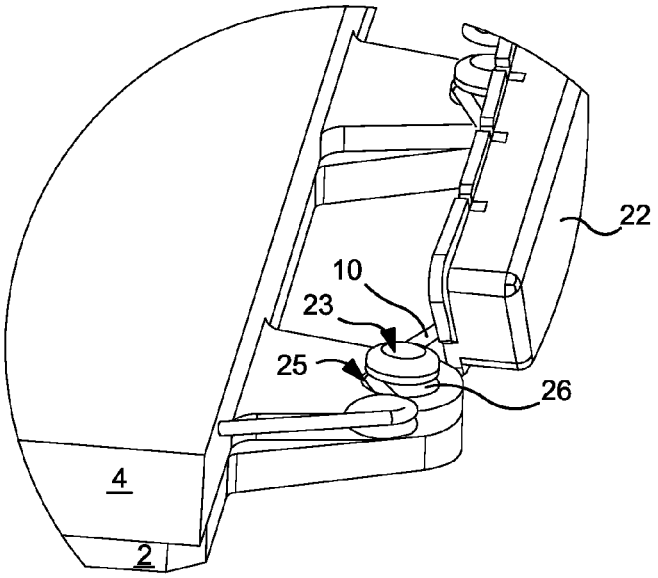
FIG. 5 shows a spatial view of a section from FIG. 4 from a different perspective.

The detachable connection according to FIGS. 4 and 5 differs to a greater extent from the two embodiments described so far (also in this case, functionally comparable elements are, however, designated with the same reference number as in FIGS. 1 to 3, even if they have a different shape): more schematically, the accommodating device 2 is indicated by a base plate which has two cones 23 sticking out in a perpendicular manner along its one edge 3, which have a circumferential groove 26 just underneath their upper end. Once the exchangeable block 4 has been placed on the accommodating device 2 from above in such a manner that the horizontal contact surfaces 6, 8 of the accommodating device 2 and the exchangeable block 4 are adjacent to one another (FIG. 5), a form fit is achieved by a spring wire 10 being pressed laterally into the latter. In this position, the two cones 23 extend through borings 25 on the exchangeable block 4, stick out on top of the borings 25, so that the grooves 26 are exactly flush with the lower edge of the borings 25—and, pressed into there through its elastic force, the spring wire 10 grasps the grooves 26 laterally.

Through this lateral pre-stressing, the undercut, which is formed, firstly, by the upper edge 16 of the grooves 26, and, secondly, by the top of the spring wire 10, is interlocked horizontally.

Along the edge 30, which is located opposite the edge 3, the accommodating device 2 and the exchangeable block 4 have pre-positionable connecting elements 32 which are a form fit, which likewise ensure, through an undercut, as well as lateral stops, that the exchangeable block 4 and the accommodating device 2, do not move away from one another vertically (due to the undercut in the elements 32) or shift horizontally (in the direction of the edges 3, 30) (due to the lateral stops in the elements 32). The remaining degrees of freedom are laid down based on the form-fit connection between the cones 23 and the borings 25, as well as based on the undercut between the spring wire 10 and the grooves 26.

This detachable connection between the accommodating device 2 and the exchangeable block 4 can be detached by a push button 22, which presses the spring wire 10 out from the grooves.

Figure 6:
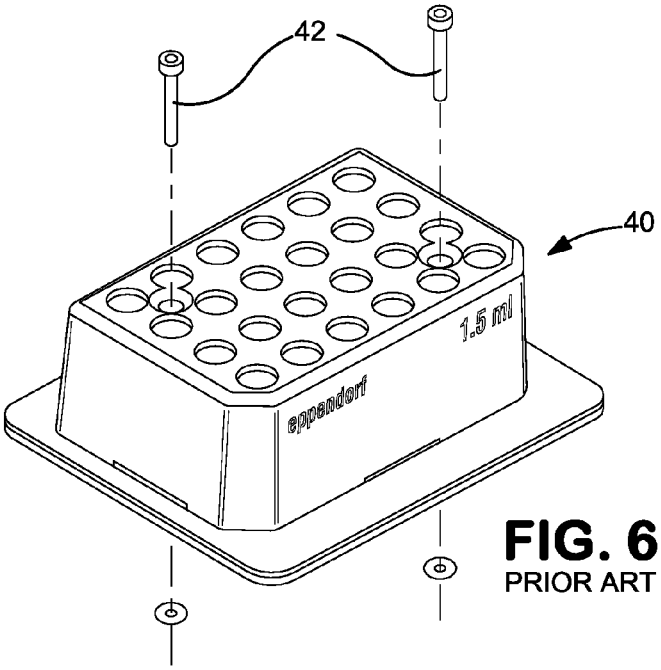
FIG. 6 PRIOR ART
FIG. 6 shows a spatial view of an exchangeable block according to the state of the prior art.
Figure 7:
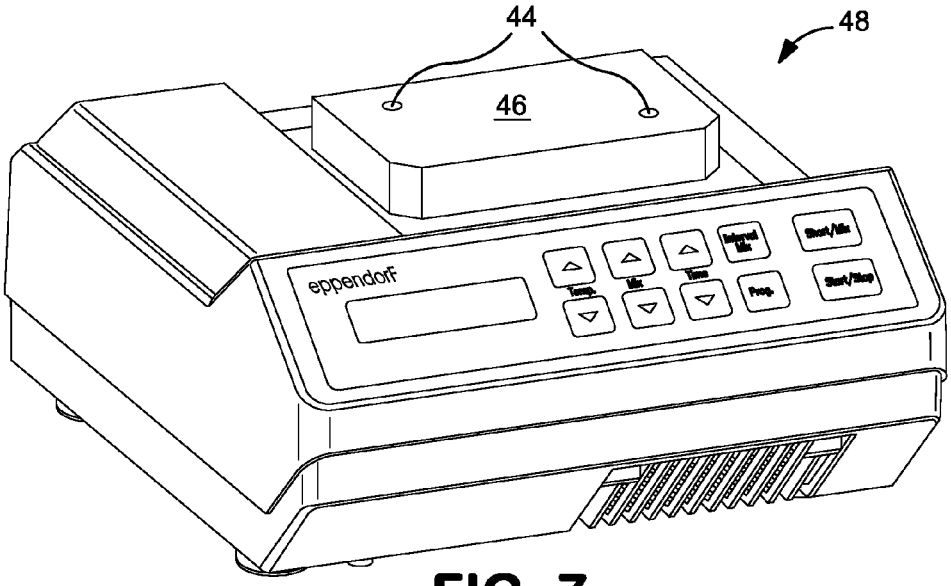
FIG. 7 PRIOR ART
FIG. 7 shows a mixing device according to the state of the prior art, without the exchangeable block from FIG. 6.

In regard to FIGS. 6 and 7, merely by way of illustration, an exchangeable block 40 (FIG. 6) designed according to the state of the prior art is shown, which can be detachably attached, by means of two screws 42 and two threaded holes 44, to an accommodating device 46 of a mixing device 48 designed according to the state of the prior art.

The invention claimed is:

1. An apparatus for mixing and controlling the temperature of laboratory vessel contents which comprises an accommodating device (2) connected by a detachable connection to a holder (4) for accommodating and controlling the temperature of laboratory vessels, a drive through which the accommodating device (2) can be put into a mixing motion, and a temperature control device with a source of heat or sink, wherein the holder is an exchangeable block (4) with a contact surface (8), the temperature control device has a contact surface (6) on the accommodating device (2), the temperature control device and the vessel holder are connected so that thermal conduction occurs, through the contact surfaces (6, 8) being close together, the detachable connection is held by a spring element (10), which, through its spring tension, clamps together a first undercut (16) between the accommodating device and the exchangeable block (4) horizontally in at least one first direction; and the undercut has two mould parts (18, 20) undercutting one another, at least one of which has a form-fit active surface, which is orientated on an incline to the contact surfaces which adjoin one another horizontally in such a way that the horizontal clamping together effects a vertical clamping force towards each other of the contact surfaces which are horizontally adjacent to one another.

2. The apparatus according to claim 1, wherein, through its spring tension, the spring element and/or a second spring element tightens a second undercut in a second direction horizontally into the first undercut.

3. The apparatus according to claim 1 or 2, wherein the spring element is a lateral pressure component.

4. The apparatus according to claim 2, further comprising a lever for detaching the connection, with which at least one of the spring elements can be moved in such a way that the spring tension which effects the tightening is reduced.

5. The apparatus according to claim 1 or 2, wherein the first undercut is achieved through a mould part on the accommodating device and/or a mould part on the exchangeable block.

6. The apparatus according to claim 1 or 2, wherein the spring tension of the spring element is between 30 and 150 N.

7. The apparatus according to claim 6, wherein the spring tension of the spring element is between 50 and 100 N.

8. The apparatus according to claim 2, wherein two spring elements for clamping the exchangeable block are orientated in a horizontal direction.

9. The apparatus according to claim 1, wherein the form-fit active surface is an inclined plane.

10. The apparatus according to claim 1, wherein, in order to detach the connection, the contact surfaces which are horizontally adjacent to one another can be pressed apart from one another using a lever device, and wherein the contact surfaces on the accommodating device and the exchangeable block are orientated in such a way that the detachable connection can be snapped out by the pressing.

11. The apparatus according to claim 1, wherein, in order to detach the connection, at least one of the two mould parts of the undercut undercutting one another can be moved out laterally from the undercut.

12. The apparatus according to claim 1, wherein the two contact surfaces on the accommodating device and the exchangeable block are orientated in such a way that they permit the detachable connection to be snapped in from a previous position by applying vertical pressure.

* * * * *